US010858074B1

(12) United States Patent
Walker

(10) Patent No.: US 10,858,074 B1
(45) Date of Patent: Dec. 8, 2020

(54) RADIAL ARM DOUBLE SHANK SPLIT CROWN SELF-RELEASING MECHANISM ANCHOR

(71) Applicant: Russell D Walker, Cape Coral, FL (US)

(72) Inventor: Russell D Walker, Cape Coral, FL (US)

( * ) Notice: Subject to any disclaimer, the term of this patent is extended or adjusted under 35 U.S.C. 154(b) by 0 days.

(21) Appl. No.: 16/873,229

(22) Filed: Feb. 28, 2020

(51) Int. Cl.

| | |
|---|---|
| ***B63B 21/46*** | (2006.01) |
| ***B63B 21/24*** | (2006.01) |
| *B63B 21/36* | (2006.01) |
| *B63B 21/26* | (2006.01) |

(52) U.S. Cl.
CPC ..... *B63B 21/46* (2013.01); *B63B 21/24* (2013.01); *B63B 21/36* (2013.01); *B63B 2021/262* (2013.01)

(58) Field of Classification Search
CPC ..... B63B 21/00; B63B 21/24; B63B 21/38; B63B 21/44; B63B 21/46
USPC ..... 114/297, 298, 299
See application file for complete search history.

(56) References Cited

U.S. PATENT DOCUMENTS

| | | | | |
|---|---|---|---|---|
| 3,404,652 | A * | 10/1968 | Gardy | B63B 21/44 114/297 |
| 4,134,355 | A * | 1/1979 | Carruthers | B63B 21/38 114/297 |
| 4,369,727 | A * | 1/1983 | Fasco | B63B 21/46 114/297 |
| 2009/0314196 | A1 * | 12/2009 | Richert | B63B 21/46 114/297 |

* cited by examiner

*Primary Examiner* — Lars A Olson

(57) ABSTRACT

A common experience for boat owners is to lose anchors, particularly when anchored next to structure, wrecks, sunken debris, tree roots, rocks or other obstacles that are likely to become firmly engaged, holding the flukes of an anchor. Attempts to release the anchor by maneuvering the boat or by the manipulation of the anchor line often prove futile and succeed only in increasing the entanglement of the anchor. Ultimately it may lead to anchor loss or even loss of life of those on board the boat. This fluke style anchor mechanism design was invented by research and development through which the inventor created the Radial Arm Double Shank Split Crown Self-Releasing Mechanism Anchor providing a superior, safer, practical and economical solution to overcome the aforementioned problems of past art devices referenced herein or exhibited within this document shown in exhibits; Description of the Prior Art or Patent Citations and Searches.

1 Claim, 5 Drawing Sheets

Radial Arm Double Shank Split Crown Self-Releasing Anchor
Drawing by Russell D Walker, Inventor

Radial Arm Double Shank Split Crown Self-Releasing Anchor

Drawing by Russell D Walker, Inventor

Radial Arm Double Shank Split Crown Self-Releasing Anchor

Drawing by Russell D Walker, Inventor

Side View cutaway without Anchor Flukes Demonstrate Radial Arm Release Process

Radial Arm Double Shank Split Crown Self-Releasing Anchor

Drawing by Russell D Walker, Inventor, December 12, 2019

View of Radial Arm Rotation Process While Pivoting on Bar Stock After Nylon Pin Shear

Radial Arm Double Shank Split Crown Self-Releasing Anchor

Drawing by Russell D Walker, Inventor

View of Radial Arm Rotation Process After Nylon Pin is Sheared

Radial Arm Double Shank Split Crown Self-Releasing Anchor

Drawing by Russell D Walker, Inventor

Figure 5. Demonstrates Continued Radial Arm Movement Process Towards Full Reversal

RADIAL ARM DOUBLE SHANK SPLIT CROWN SELF-RELEASING MECHANISM ANCHOR

BACKGROUND OF THE INVENTION

(1) Field of the Invention

This invention relates generally to pleasure, and fishing boat anchoring systems known to exist and are available today to the public for purchase however, it can be for commercial use also. Continued research has been done to provide an improved means for instant anchoring and an effortless retrieval in the event the anchor hangs on the bottom. Our Invention is unique yet simple comprised of several mechanical components found here in the Freedom Radial Arm Double Shank Split Crown Self-Releasing Mechanism Anchor, which is the patent art of this application.

(2) Background Discussion

Something that is never spoke of in other anchor patent designs is addressed here forthwith: Critical need was the Inspiration for the invention as a boat anchoring accident is detailed in the paragraph and clip below.

Solution by the invention: Possible Elimination of Loss of Life. Many Lives are lost, nationally, each year when unsuspecting boaters try to pull the anchor free from a snag on the bottom by attaching the rope to the stern cleat of their boat then pulling against the anchor with the power of the boat. This usually results in rapidly capsizing the boat, without warning, resulting in one or more of the occupants on board drowning. This invention may prevent loss of life due to the Radial Arm Double Shank Split Crown Self-Releasing Anchor mechanisms ability to free itself automatically from subsurface anchor hang ups in all but the most exceptional circumstances.

Case in point: Example; Tampa News Article, Mar. 27, 2009, Florida agency rules bad anchoring, revving engine while pulling hung anchor made boat capsize. Attempt to pull hung anchor from stern caused Football players boat to flip resulting in the deaths of two people. https://www.nydailynews.com/news/world/fatal-boat-accident-involving-nfl-players-marquis-cooper-corey-smith-caused-improper-anchoring-article-1.366690

This revolutionary anchor mechanism design is presented in order to prevent loss of Lives, eliminate equipment loss and protect the environment.

BRIEF SUMMARY OF THE INVENTION

The invention is continued evolutionary in origin inspired by specific needs, both as to its composition and method of operation along with further objectives and advantages thereof, may best be understood by reference to the following description taken in connection with the accompanying drawings. For the purpose of facilitating and understanding my invention, I have illustrated in the accompanying drawings the preferred embodiment thereof, from an inspection of which, when considered in connection with the following description, its mode of construction, assembly and operation, and many of its advantages should be readily understood and appreciated. This revolutionary anchor apparatus will save human lives, protect the environment, provide a highly economical means of reliable anchoring and equipment prevent loss.

The Invention: Radial Arm Double Shank Split Crown Self-releasing Mechanism Anchor, A boat anchor having a, single or double main fluke member with said elongated attached fluke structure forming the main body of the anchor; incorporating a Radial Arm Double Shanked Split Crown Self-Releasing Anchor mechanism to allow retrieval of said anchor when at least one or more fluke/s of the anchor is caught in an underwater snag entanglement, and is further described as a;

A radial arm, split crown, double shank self-releasing mechanism anchor, which incorporates twin shanks, whereby both shank flats pivot at their base length via a minimum ½" hole drilled thru side to side allowing sufficient distance between the shank end and the edge of the drilled bar stock hole for strength, both are secured on the balance bar stock, where a 1"×½"×$\frac{1}{16}^{th}$" stainless washer is found between the two shanks to hold their respective working positions captive within the split crown.

When dropped to the bottom and dragged into anchoring position by the boat operator, the slightly shorter anchor shank within the Split Crown halves, is allowed to pivot on the balance bar stock where it seeks the Split Crown ledge Anchor Stop on its respective side of the Split Crown which makes the fluke system of the anchor divert downward and into the marine floor sediments while being pulled along the underwater bottom, in tension, to secure the anchoring process to the point where the anchor catches or fully lodges.

However, in the event one or more of the flukes become entangled within a snag or obstruction, The second, longer alternate, radial arm shank that twins the anchor shank horizontally, side by side, connected to the anchor shank by means of a ¼×1"×20 threaded nylon pin, plastic bolt or heavy nylon or plastic zip tie receives a continued upward tug of approximately 50 lbs of pressure of the rope at anything over 45 degrees vertically against the entangled anchor, it causes the shear pin holding the anchor shank and the radial arm shank together to shear and separate from each other. While the anchor shank remains hung, the process of allowing the radial arm shank to begin its 180 degree arc rotation process towards the surface thru the open side of the Split Crown passage known as the Gate, towards complete reversal of its original position of the shank to a near vertical and opposite position where it can now be continually pulled straight up causing the anchor, in its entirety to reverse out of and be lifted up and away from the underwater snag completely and safely retrieved to the surface.

Brief Description of Related Art Including Information Disclosed Under 37 CFR 1.97 a,

1. Shows the Radial Arm Side of the Anchors Split Crown centered on the Balance Bar.
2. Shows the Anchor Side of the Split Crown centered on the Balance bar.
3. Indicates the Split Crown Anchor Shank Stop. This is the part of the anchor where the Anchor Shank is stopped by the Anchor Stop side of the Crown that allows the anchor to position itself for grabbing into sediments on the bottom during the anchoring process.
4. Shows the Balance Bar of the anchor which also serves as the pivot point for the Double Shanks which are held captive inside the Split Crown, one known as the Radial Arm Mechanism the other is the Anchor Shank. Balance Bar is solid, round steel bar, ½"×18" wide this model.

5. Indicates a "captive" (spacer), Stainless-steel washers needed to separate the two shanks ensuring proper activation of the Radial Arm Mechanism release when the nylon pin is sheared. Washer is 1.5" O.D.×1/16th" with %"+ holes for this model.
6. Shows the Anchor Fluke 12.5" long this model, welded to the Balance Bar which may have one or two flukes and may not be of this particular shape as long as it's capable of penetrating sediments on the bottom with the allowed angle of attack of which the optimum is 30 to 33 Degrees. (Fluke is 12.5" long tapered and 4.75" at its widest point)
7. Shows the Anchor Shank in relation to the twin Radial Arm Mechanism shank. For this anchor size the Anchor shank is 21" total length.
8. Shows the threaded Shear pin insertion orifice which penetrates both anchor and radial arm shanks. Testing indicates that optimum shear pin size for this model is ¼"×1"×20. When sheared each shank holds its portion of the nylon pin within the threads of the shanks preventing lose into the environment. Simply removed each half and replace the nylon threaded pin with a new for continued use in the self-release mode.
9. Shows the longer Radial Arm Mechanism Self-Releasing 360-degree rotating shank in relation to the twin Anchor Shank. For this anchor size the Radial Arm shank is 24" total length.
10. Shows the ⅝ths inch anchor chain connection hole at the end of the radial arm mechanism shank. Clevis hooks through the hole, attaches anchor chain coupled to anchor rope then up to vessel.
11. A 5/16ths inch hole thru the radial arm shank designed to hold the zip tie tail captive to prevent its loss into the environment if the zip tie is used in lieu of the nylon shear pin.
12. A 5/16ths inch hole thru both shanks allows for a stainless, self-release system, nullification bolt. This is used when solid or extended anchoring is required and hang up is not anticipated.
13. Shows the Radial Arm Gate of the mechanism. A passage thru the split crown whereby the Radial Shank Release Arm passes through it during the arc's travel process in order to establish reverse pull on entangled anchor.

Figure 2:
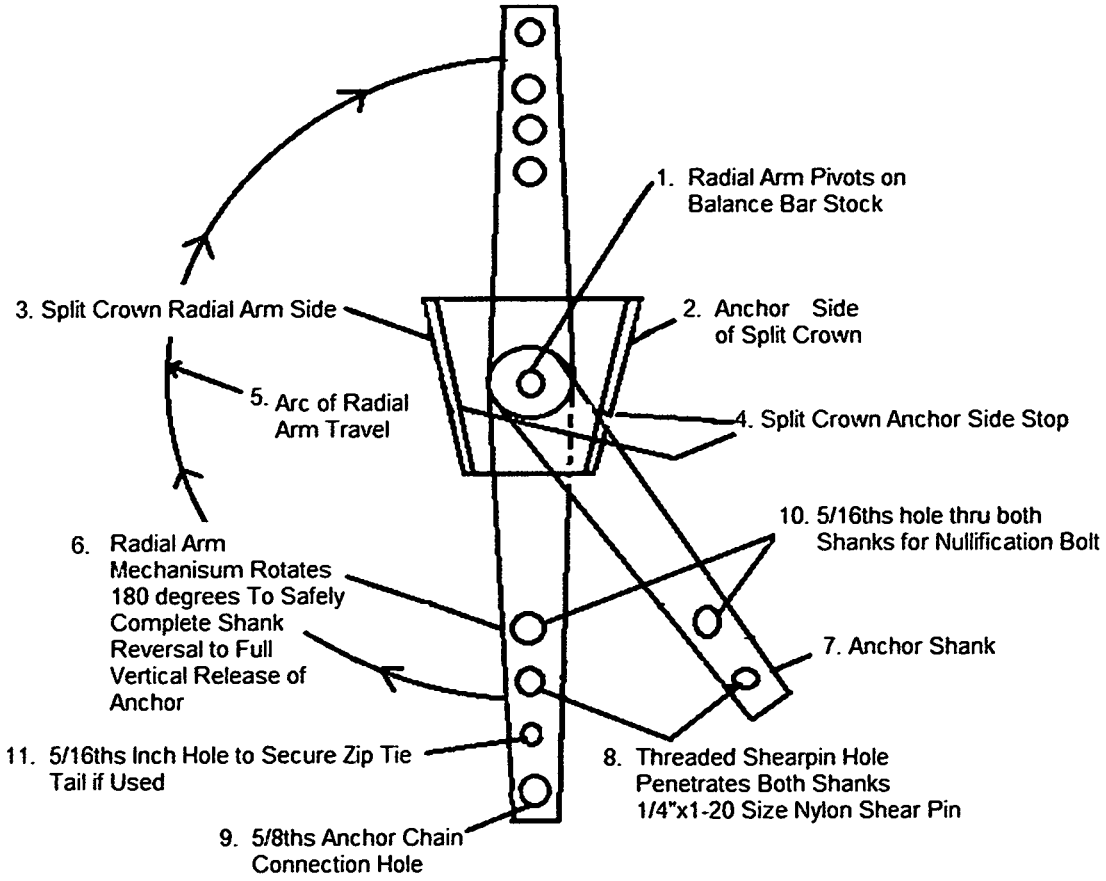

FIG. 2. Side View (Less Flukes) of the Radial Arm Double Shank Split Crown Self-Releasing Anchor Mechanism demonstrating its ability to move up to 360-degrees of movement during the release process by the rotating radial arm mechanism shank in relation to the anchor shank.

1. Shows the Radial Arm Mechanism pivot point of the balance bar stock at center.
2. Shows the Anchor Side of the Split Crown.
3. Shows the Radial Arm Mechanism side of the Split Crown.
4. Shows the Split Crown Anchor Shank Stop.
5. Indicates the Travel Arc of the Radial Arm Mechanism Shank once the Shear-pin is sheared away from the Anchor Shank.
6. Shows the Radial Arm Shank Mechanism and its ability to rotate either direction, up to 360 degrees around the center pivot point of the balance bar of the anchor to a full vertical reverse pull to release the anchor.
7. Shows the Anchor Shank itself in anchoring position, maxed against the Split Crown Anchor stop.

8. Indicates the Threaded Shear-pin orifice which penetrates both the radial arm shank and anchor shank to seat the threaded shear-pin. Optimum size, this model is ¼'×1"×20 nylon screw.
9. Shows a ⅝ths inch anchor chain connection hole.
10. 5/16ths inch hole thru both shanks side to side allows for stainless Self-Release nullification bolt when solid, non-release anchoring is required when snags are not anticipated.
11. Indicates a 5/16ths hole thru the radial arm shank to pull the zip tie tail, if used in lieu of shear pin, completely through to hold it captive and prevent loss into the environment when it shears.

Figure 3:
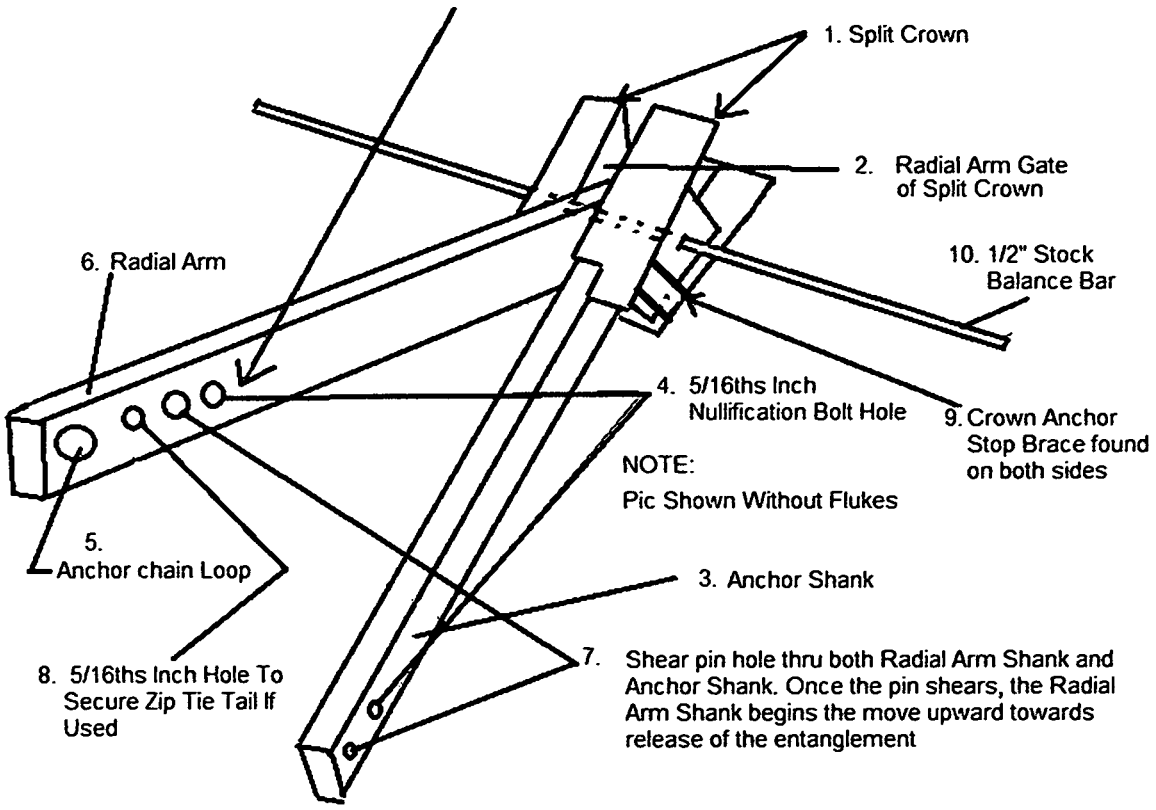

FIG. 3. Side View Cutaway of the Radial Arm Double Shank Split Crown Self-Releasing Anchor Mechanism without Flukes. Figure Shows Continued Radial Arm Rotation Process While Operating (Pivoting) After the Nylon Pin Is Sheared.

NOTE: Pic of Anchor is absent of Flukes for clarity of the invention Radial Arm Release process mechanism.

1. Shows Split Crown which allows for 360-degree Radial Arm Rotation in either direction.
2. Indicates the Radial Arm Shank Travel Gate passageway through the Split Crown.
3. Shows Anchor Shank 21" Total Length of this model.
4. Shows 5/16ths Self-Release Nullification bolt hole that penetrates both shanks.
5. Indicates loophole where anchor chain attaches. (Note: To longer Radial Shank Arm only)
6. Shows Radial Arm Shank 24" Total Length of this model.
7. Threaded Shear Pin hole thru both Radial Arm Shank and Anchor Shank. Once the nylon pin shears, the Radial Arm Shank begins to rotate upwards 180 degrees towards vertical release, up and away from the entanglement.
8. Indicates 5/16ths inch hole thru radial arm shank provided to hold captive zip tie tail in the event it is used in lieu of the nylon shear pin thus keeping it from loss into the environment.
9. Brace found on both sides of Split Crown Anchor stop.
10. Round Stock Balance Bar of the construction. Width varies ½"×18" plus wide.

Figure 4:
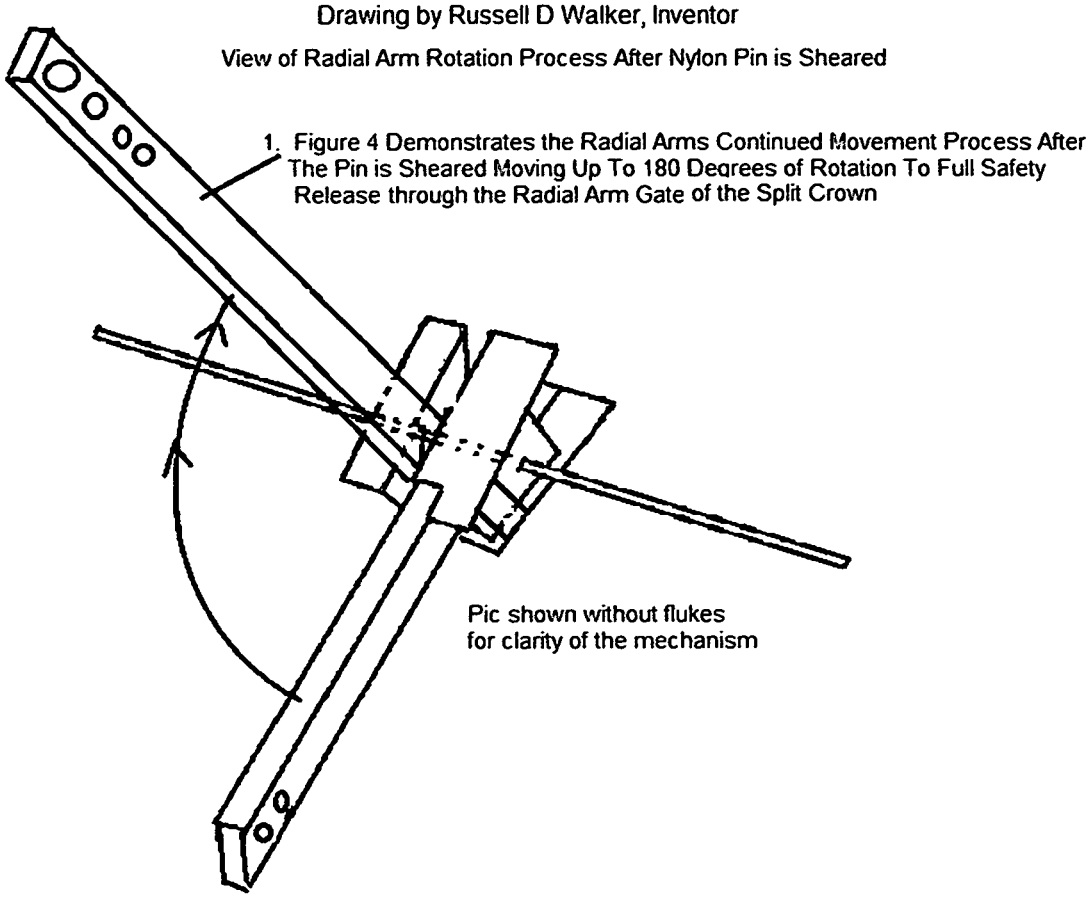

FIG. 4. View of Radial Arm continued operational rotation process after nylon pin is sheared.

1. FIG. 4. Demonstrates the Radial Arm Shank Continued Movement Process, After the Pin is Sheared, Moving Towards 180 Degrees of Rotation, Towards A Full Safety Release fully reversing towards vertical through the Radial Arm Gate of the Split Crown.

Figure 5:
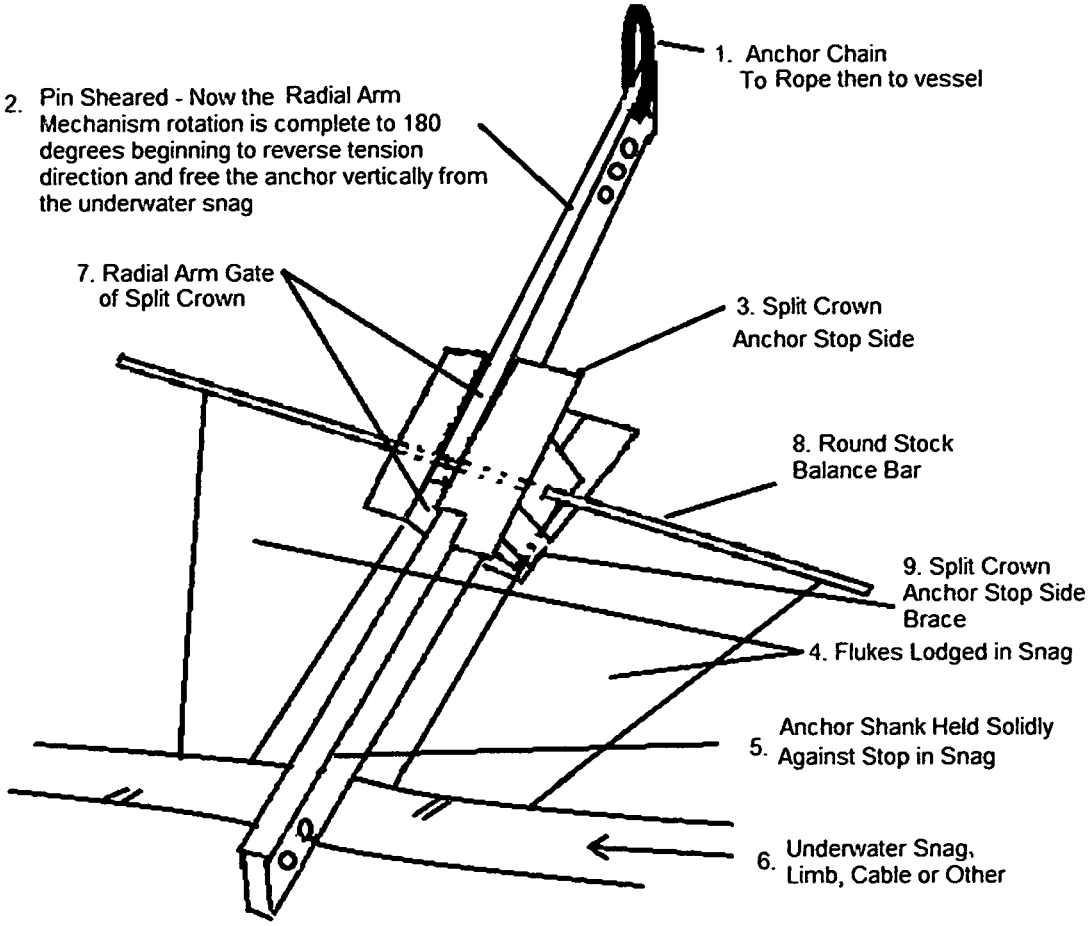

FIG. 5. Demonstrates Radial Arm Release continued rotation process while operating after nylon pin sheared at full reversal.

1. Indicates anchor chain to rope then upwards to surface vessel.
2. Shows the Radial Arm Mechanism shank, after shear, at full 180 degrees of rotation allowing a slight tug fully reversing and releasing the anchor shanks ability to hold which allows the anchor, in its entirety to be lifted upward, completely away from the underwater snag.
3. Shows Inventions Split Crown Anchor Shank stop side.
4. Indicates Flukes lodged or entangled in an underwater snag.
5. Shows anchor shank held in snag.

6. Shows underwater snag, possibly a limb or cable.
7. Shows the Radial Arm Shank Gate passage through the split crown.
8. Round Stock Balance Bar of the construction. Width varies ½"×18" plus wide.
9. Brace found on both sides of Split Crown Anchor stop only.

DETAILED DESCRIPTION OF THE INVENTION

Figure 1:
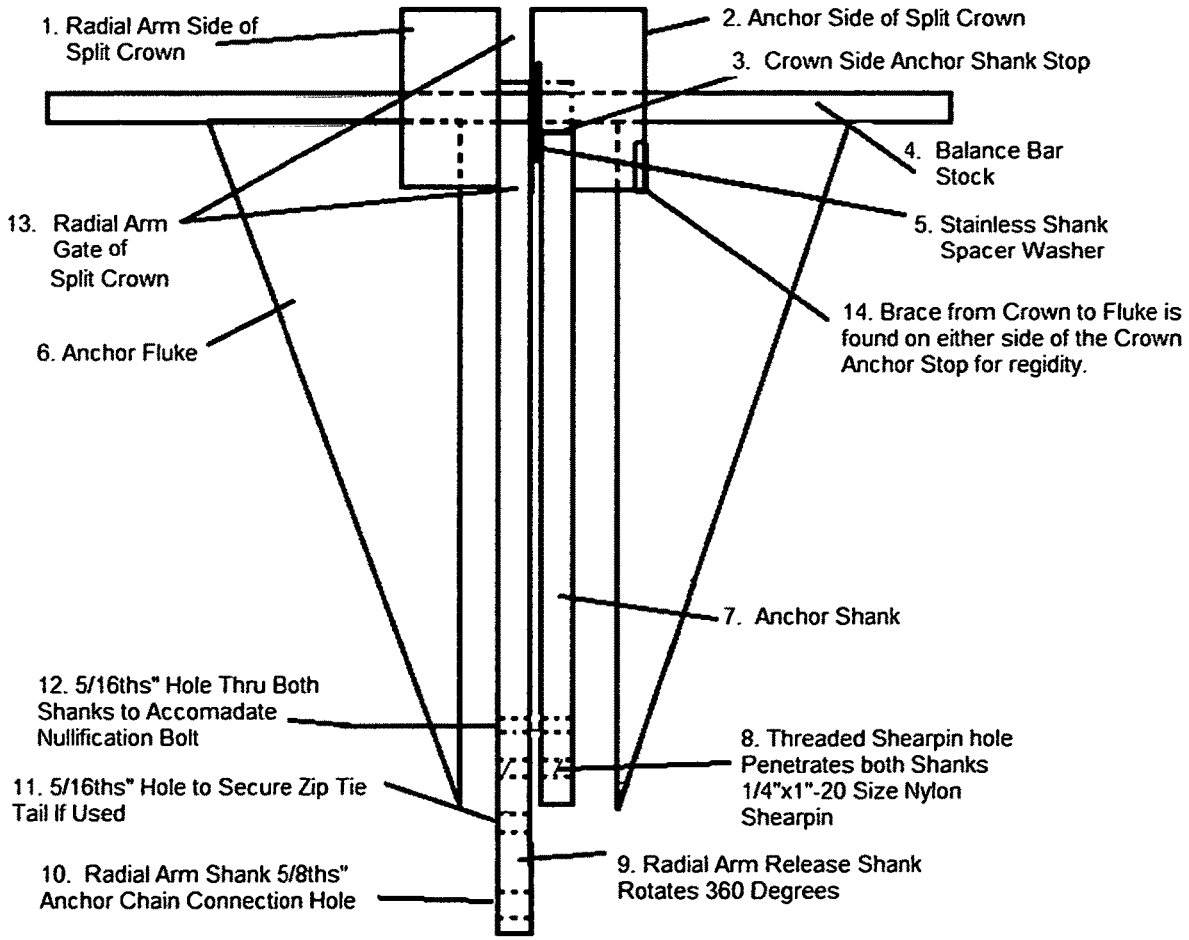
FIG. 1. Top View of the Radial Arm Double Shank Split Crown Self-Releasing Anchor Mechanism. This model weighs near 12.5 pounds. Drawings are described but not to scale.

This invention provides for a specifically designed boat anchor for use and safe retrieval in the event the anchor hangs up on bottom. Either a double or single fluke style anchor, whereby our Radial Arm Double Shank Split Crown Self-Releasing Mechanism Anchor, FIG. 1 is incorporated which can be activated once the anchor is set or entangled by pulling the anchor line vertically. While the Anchor shank remains firmly in place wedged against the Split Crown, Anchor Shank stop FIG. 1-14, hung in the entanglement, the longer Twin Radial Arm Shank FIGS. 1-9 bears the continued brunt of the force being applied against it, a replaceable, threaded nylon shear pin FIG. 1-8 that holds the two shanks together, is then sheared near the chain connection end of the Radial arm shank separating the Anchor Shank FIG. 1-7 and the Radial Arm Release shank FIGS. 1-9. This motion usually requires a maximum of 50-pounds vertical of pull on the anchor line at over 45 degrees angle to activate the nylon shear pin release mechanism and start the Radial Arm arc rotation process FIGS. 2. 5 & 6, to full reversing release from the entanglement.

Note: Once the Nylon pin is sheared into, each half of the pin is held captive within the threads of the pin hole in each of the shanks preventing loss into the environment FIGS. 1-8. Removal, replacement and disposal of the sheared pin is quick and simple and can be done in mere seconds.

As an inexpensive alternative, appropriately secured heavy duty zip ties may be substituted in lieu of nylon shear pins. An additional 5/16ths hole FIG. 1-11, located in the radial arm shank neck is provided so that the tag end of the zip tie can be pulled through it; when properly installed the zip tie will be held captive to prevent its loss into and protect the environment.

To the process of our anchor's ability to self-release. If hung in a snag at depth, the Anchor shank and the Radial Arm release shank mechanism are held together side by side by a nylon shear pin bolt (¼×1"×20) within the split crown to operate as a normal anchor of this type would operate yet when manually lifted vertically over the anchor snag to the point where the crown anchor stop is met, FIG. -14, if the longer Radial Arm shank receives continued lifting force while in a snag it will result in shearing the threaded nylon pin that is holding the two shanks together allowing separation of the union of the companion Anchor Shank. A stainless spacer is located FIG. 1-5, to maintain both the Radial Arm Shank FIG. 1-9 and the Anchor Shank FIG. 1-7, each in their respective, operative positions of the Split Crown FIGS. 1 & 2, where they are both held captive.

Post shear, the Radial Arm shank then continues in a radial arc upwards pivoting on the balance bar stock FIG. 14, (also see FIGS. 2 #5 & 6 in the Drawings section of this application), inside the Split Crown assembly, thru the Split Crown opening or separation known as the Gate FIGS. 1-13 accommodating the Radial Arm's travel continuing on upwards FIG. 4-1, around towards a complete vertical position FIG. 5-2.

Then at the height of its 180-degree reversing rotation on the bar stock axis, the Radial Arm shank allows itself to be pulled straight up FIG. 5-2. FIG. 5-1, along with the accompanying anchor, away from the entanglement, nullifying the ability of the Anchor Shanks ability to be held in the entanglement FIG. 5-6, any longer.

Very important note; that the Radial Arm mechanism shank process can rotate (Pivot) in either direction in a full 360 degrees due to the path through the Split Crown apparatus so, regardless of which side of the anchor is lying up or down in position on the water body bottom, the mechanism works from either side to free an anchor that is hung up on bottom. FIGS. 5-1

The Radial Arm Double Shank Split Crown Self Releasing Anchor Mechanism utilizing the Gate passage thru the Split Crown FIG. 5-7, is an integral portion of the patent art of this invention, not necessarily the shape of the anchor. The model represented in the attached drawings can be modified or made proportionately larger for increased anchoring needs regardless; the Radial Arm Double Shank Split Crown Self-Releasing Mechanism art remains the same operationally.

The Anchor Shank and the Radial Arm Shank both have a 5/16ths hole drilled through them directly opposing each other from side to side, one to the other whereby a stainless-steel bolt utilizing a stainless Ny-Lock nut may be inserted thru the two shanks FIG. 1-12, tightened to nullify the anchors nylon pin shear systems ability to work. This is be done when circumstances may call for more solid, or overnight non-release anchoring, making it even more diverse, economical and useful. Whereas most inventions become exceptionally expensive or cumbersome, simplicity and common sense has produced the very economical, practical, affordable and diverse anchoring system presented here known as the Radial Arm Double Shank Split Crown Self-Releasing Mechanism Anchor.

The foregoing disclosure and description of the invention are illustrative and explanatory thereof and, it will be understood by those skilled in the art, that various changes in the size, shape and materials, as well as in the details of the illustrated construction, may be made within the scope of the appended claims without departing from the scope or spirit of the invention. The Radial Arm Split Crown Twin Shank Self Releasing Mechanism Anchor is the patent art of this invention. Fluke styles, anchor shapes or sizes may vary without losing the scope or spirit of the invention.

DESCRIPTION OF THE PRIOR ART

Boat anchors have been in use for many years to stabilize boats in the water. An anchor is generally a large, heavy, double hooked device which, when dragged by the boat, embeds the ends of the hooks or flukes into the floor of a sea, lake, or river bracing the boat. The floors of these water ways, however, contain many natural as well as man-made obstacles with which anchors can become entangled.

The general rule of practice when an anchor cannot be dislodged by simple winching, is to reverse the direction of the boat, approach the anchor from above or more often, the opposite side, and pull the anchor out backwards. Should the end portion or bill of the fluke be embedded, for instance under a log, this normal removal procedure would more than likely prove useless and dangerous. This is due to the fact that when the upper shank portion of the anchor is pulled in the opposite direction, the fluke is actually driven further upward under and around the log or snag. Therefore, the need for an anchor which could be easily retrieved once snagged was obvious of even self-release. Some of the past art retrievable anchors similar to ours have shanks or flukes which can be disengaged from a stationary position via additional ropes or ring type leverages which seldom work. Others have proven to be unreliable anchoring systems either by design or function. The following past art patented devices are indicative of these types of disengage able anchors:

The Brown patent, issued Jun. 7, 1983, U.S. Pat. No. 4,386,575, shows a flat fluke anchor having an accessory extracting cable in conjunction with the anchor cable. When embedded, the extracting cable is activated, changing the angle of the flukes and allowing them to be extracted from the sea floor.

El-Ramey was granted U.S. Pat. No. 4,417,538, for anchor which utilizes a vertical pull to break a replaceable tie, releasing the stationary positioning of the flukes. Unlike our anchor mechanism, this anchor has limited holding capabilities, is cumbersome, complex and involves expensive construction.

The Fasco device, U.S. Pat. No. Re. 31,654, shows an anchor where the flukes are automatically disengaged when the shank is tipped or pulled at a certain angle The U.S. patent granted to Marshburn et al, U.S. Pat. No. 2,870,731, shows a spring biased shank, whereby excessive pulling force compresses the spring and disengages the flukes.

White was granted U.S. Pat. No. 3,182,625, for an anchor having a slidably affixed anchor line, allowing the point or direction of pulling force to be altered.

A snag-resistant anchor was patented by Carruthers, U.S. Pat. No. 4,134,355, which shows a bifurcated outer shaft with a single center shaft which disengages longitudinally with the first, altering the angle of the flukes.

Ross was granted U.S. Pat. No. 3,491,712, for a self-releasing anchor which disengages the flukes by manipulation of a secondary anchor line.

Several of the past art anchors utilize a secondary anchor line in addition to the main anchor cable, to activate the release mechanisms. The additional anchor line presents the increased risk of entanglement of the two lines.

Other past art anchors may have detachable mechanisms similar to our device which are activated when the anchor line is at a specific angle to the shank detaching from a U-Like, release clamp. This clamp design has little resilience for prolonged use and fatigues quickly rendering the device worthless and the anchor inoperative as is evident by their absence from today's anchor markets. Although these anchors may be somewhat similar, none are structured or built like, nor do they function in the same manner as our device which incorporates the Radial Arm Double Shank Split Crown Self Releasing Mechanism. Our anchor is simple in design while increasing safety for personal use, functional yet economical offering years of use while providing additional benefits and advantages noted, not found in any of the past art devices.

PATENT CITATIONS AND SEARCHES

1. Marine Anchor with Release Capability
Inventors:
El-Ramey, Thomas A. (Rte. 2, Box 813, Pompano Beach, Fla., 33067)
Application Number:
Ser. No. 06/296,959
Publication Date:
Nov. 29, 1983
Filing Date:
Aug. 27, 1981
Export Citation:
Click for automatic bibliography generation
Assignee:
EL-RAMEY; THOMAS A.
Primary Class:
114/298
Other Classes:
114/297, 114/304, 114/310
International Classes: B63B21/44; (IPC1-7): B63B21/44
Field of Search: 114/298, 114/299, 114/294, 114/297, 114/304, 114/310

2. Boat Anchor
Inventors:
Brown, Robert F. (2625 State Rd. 590, Apt. 2524, Clearwater, Fla., 33519)
Application Number:
Ser. No. 06/218,468
Publication Date:
Jun. 7, 1983
Filing Date:
Dec. 22, 1980
Export Citation:
Click for automatic bibliography generation
Assignee:
BROWN; ROBERT F.
Primary Class:
114/299
Other Classes:
114/297, 114/303
International Classes:
B63B21/46; (IPC1-7): B63B21/46
Field of Search:
114/94-311, 52/162, 52/163, 52/166

3. Snag Resistant Anchor
Inventors:
Carruthers, John A. (30 Coates Ave., Auckland, NZ)
Application Number:
Ser. No. 05/792,218
Publication Date:
Jan. 16, 1979
Filing Date:
Apr. 29, 1977
Export Citation:
Click for automatic bibliography generation
Assignee:
CARRUTHERS; JOHN A.
Primary Class:
114/297
Other Classes:
114/304
International Classes: B63B21/22; B63B21/38; (IPC1-7): B63B21/38
Field of Search:
114/301, 114/302, 114/303, 114/304, 114/305, 114/306, 114/307, 114/308, 114/309, 114/310, 114/298, 114/299, 114/297, 24/241S, 24/11SF, 24/201TR 4. Self-Releasing Anchor
Inventors:
Ross, John J.
Application Number:
U.S. Pat. No. 3,491,712DA
Publication Date:
Jan. 27, 1970
Filing Date:
Aug. 22, 1968

Export Citation:
Click for automatic bibliography generation
Assignee:
Ross, John J.
Primary Class:
114/298
International Classes:
B63B21/24; (IPC1-7): B63B21/34

5. Non-Fouling Anchor
Inventors:
Farr, Claude B.
Application Number:
U.S. 68/644,457A
Publication Date:
Nov. 24, 1959
Filing Date:
Sep. 26, 1957
Export Citation:
Click for automatic bibliography generation
Assignee:
Farr, Claude B.
Primary Class:
114/298
International Classes:
B63B21/36; B63B21/46

REFERENCED BY

US Patent References:
U.S. Pat. No. 2,914,015 Non-fouling anchor 1959 Nov. 24
U.S. Pat. No. 2,797,658 Antifouling anchor 1957 Jul. 2
U.S. Pat. No. 2,709,980 Anti-fouling anchor with fluke revolving and locking means 1955 Jun. 7

The invention claimed is:

1. A boat anchor with a radial arm, double shank, split crown, self-releasing mechanism, said anchor comprising a single or double main fluke member that forms a main body of said anchor, and a pair of pivotable shanks that are both secured to a balance bar stock, said pair of pivotable shanks further comprising an anchor shank that is pivotable on said balance bar stock to an anchor side stop on a split crown, and a longer radial arm shank that is connected to said anchor shank by a shear pin, where an upward force of approximately 50 lbs. on a rope connected to said anchor causes said shear pin holding said anchor shank and said radial arm shank together to shear, allowing said shanks to separate from each other and said radial arm shank to rotate 180 degrees through a gate in said split crown so that said radial arm shank can be pulled straight up, which allows said anchor in its entirety to reverse out of an entanglement and be lifted up and away from said entanglement.

* * * * *